US005114631A

United States Patent [19]

Nyssen et al.

[11] Patent Number: 5,114,631

[45] Date of Patent: May 19, 1992

[54] PROCESS FOR THE PRODUCTION FROM THERMOPLASTIC POLYMERS OF SUPERFINE FIBRE NONWOVEN FABRICS

[75] Inventors: Peter R. Nyssen, Dormagen; Dirk Berkenhaus, Cologne; Hans-Theo van Pey, Lipp, all of Fed. Rep. of Germany

[73] Assignee: Bayer Aktiengesellschaft, Fed. Rep. of Germany

[21] Appl. No.: 676,782

[22] Filed: Mar. 28, 1991

[30] Foreign Application Priority Data

Apr. 12, 1990 [DE] Fed. Rep. of Germany ..... 4011883

[51] Int. Cl.[5] ..... B05B 3/08; B05D 1/12

[52] U.S. Cl. ..... 264/6; 264/8; 264/12; 264/115; 425/7; 425/8

[58] Field of Search ..... 264/6, 8, 12, 115, 211.1, 264/518; 425/6, 7, 8; 156/167

[56] References Cited

U.S. PATENT DOCUMENTS 3,806,289 4/1974 Schwarz ..... 264/115

4,889,546 12/1989 Denniston ..... 65/5

4,937,020 6/1990 Wagner et al. ..... 264/6

*Primary Examiner*—Mary Lynn Theisen

*Attorney, Agent, or Firm*—Connolly & Hutz

[57] ABSTRACT

The process for the production of superfine polymer fibre novwoven fabrics is based on spinning out radically the molten polymer at supply pressure in a rotating nozzle head (6) through a plurality of discharge opening (27) to form fibres and deflecting in the axial direction the not yet completely solidified fibres at a radial distance of 10 mm to 200 mm from the discharge holes (27) by an outer gas stream (8) and afterwards depositing them as nonwoven fabric (15) on a circulating, air-permeable carrier (12). In addition to the outer gas stream (8) an inner gas stream (24) emerges at a lower velocity from a plurality of axial boreholes (23) in the nozzle head (6) at a smaller radial distance than the discharge holes (27). Owing to the centrifugal sweeping forces at the rotating nozzle head (6) a rotationally symmetrical flow field then developes with a predominantly radial velocity component, the temperature of the gas being equal to or greater than the nozzle head temperature.

13 Claims, 3 Drawing Sheets

PROCESS FOR THE PRODUCTION FROM THERMOPLASTIC POLYMERS OF SUPERFINE FIBRE NONWOVEN FABRICS

The invention starts out from a process for the production from thermoplastic polymers of superfine fibre nonwoven fabrics with a mean fibre diameter of 0.1 μm-20 μm preferably 0.5 μm-10 μm, in which the molten polymer in a rotating nozzle head is spun radially at a supply pressure of 1 bar-200 bar from a plurality of discharge holes to form fibres and the not yet completely solidified fibres are deflected in an axial direction at a radial distance of 10 mm to 200 mm from the discharge holes by an outer gas stream and afterwards deposited as nonwoven fabric on a circulating. air-permeable carrier. Such a process is described in DE-A 3 801 080.

According to the prior art, nonwoven fabrics from meltable polymers are produced in the first place by the so-called melt-blown process (see e.g. U.S. Pat. Nos. 4 048 364, 4 622 259, 4 623 576, DE 2 948 821, EP 92 819, EP 0 239 080). The elastic nonwoven fabrics produced according to EP 239 080 are characterized for example by a mean fibre diameter of above 10 μm. This range is also accessible without problems with conventional staple fibre or continuous filament spinning processes. The elastic nonwoven fabrics so produced cannot therefore strictly be called microfibre or superfine fibre nonwoven fabrics. Since the melt-blown process is based on purely aerodynamic fibre formation, in which the polymer melt is directly blown with air of high velocity (100-300 m/sec) at a temperature above the melt temperature, special conditions must be satisfied regarding the material properties of the polymer for achieving very fine fibre diameters. In particular the melt must have a low melt viscosity and creep viscosity. Polymers with low interaction forces between the polymer chains, such as e.g. polyolefins, have proved to be especially suitable. On the other hand if high interaction forces are present, such as for example with polyamide, terephthalate and polyurethane, the fibre forming process is hindered by the high elongation viscosity, which usually leads to larger fibre diameters. Even a reduction of the molecular weight is of limited help with regard to the fibre and nonwoven fabric properties. The process parameters such as melt temperature and air temperature can be varied within only a very narrow range, in contrast to polyolefins, since otherwise thermal decomposition and damage to the polymer must be taken into account. This applies to a particular degree to the raw material polyurethane.

For the production of elastic nonwoven fibre fabrics therefore in EP-A-0 239 080 the application for example of the melt-blown process with use of copolymers such as ethylene—vinyl acetate (EVA) or ethylene—methyl acrylate (EMA) copolymers is described. In example 7 of this publication, a fibre diameter of more than 10 μm is indicated for EVA. The nonwoven fabric strength as well as the extensibility show large differences between the longitudinal and transverse directions.

On the other hand the spin-blow process described in DE 3 801 080 permits the production of superfine polymer fibres with a fibre diameter of 0.1-10 μm. This process is based on first drawing in the centrifugal field the primary filaments formed (pre-draft) and then drawing them further by an axial gas stream of high velocity to superfine fibres (final draft).

With this process the production of superfine fibres is successful from polymers over a large range of melt and elongation viscosity, so that even polymers with high molecular weight and large interaction forces between the molecular chains can be used as starting materials. This is where the invention starts.

The basic problem, starting from the process described above, is to produce nonwoven fabrics from thermoplastic polymers, in particular from thermoplastic polyurethane, with the following properties:

1. The nonwoven fabric must consist of short fibres with a mean fibre diameter of 0.1 μm-20 μm, preferably 0.5 μm -10 μm.
2. The fibres must be relatively long (ratio of length to diameter >20,000).
3. The nonwoven fabric must have a high abrasion resistance as well as an improved breaking force and breaking elongation and a high elastic recovery.
4. The nonwoven fabric must have very little or no differences in the strength properties in longitudinal and transverse directions.

This problem is solved according to the invention, starting out from the spin-blow process described in DE 3 801 080, in that, in addition to the outer gas stream of high velocity, at a smaller radial distance than the melt discharge holes there emerges from a plurality of axial boreholes in the nozzle head an inner gas stream of lower velocity which, under the influence of the centrifugal sweeping forces arising at the rotating nozzle head, forms a rotationally symmetrical flow field with a predominantly radial velocity component and whose temperature is equal to or greater than the nozzle head temperature.

Advantageously in the course of this the gas flow rates of the inner and the outer gas streams are so adjusted that their ratio is between 0.2 and 2.0.

With regard to the production of a nonwoven fabric which is uniform over its whole width and in its mechanical properties, a further improvement consists in the direction of further delimiting gas streams outside the nozzle head at an axial distance 0 mm $\leqq$ a $\leqq$ 500 mm from the melt discharge holes on at least two opposite sides at an angle of 0° to 70°, preferably 10° to 60°, to the axis onto the axially deflected fibre stream.

Preferably in addition the ratio of the sum of these delimiting gas flow rates to the sum of the outer and inner gas flow rates is adjusted to a value between 0.1 and 1, preferably between 0.1 and 0.5. It has also proved beneficial if the delimiting gas flow rates are blown in at a radial distance from the nozzle head axis which is 1.5 to 5 times, preferably 1.5 to 3 times, the nozzle head radius.

The new improved spin-blow process has proved successful for the production of superfine fibre nonwoven fabrics of polyolefins, polyesters, polyamide, and especially of polyester-, polyether- or polyethercarbonate- urethane nonwoven fabrics. A subject matter of the invention also is accordingly the polyurethane nonwoven fabrics with outstanding physical properties produced by this process.

By the invention the following advantages are achieved: The superfine fibre nonwoven fabrics produced according to the new process have a mean fibre diameter which is distinctly lower than with comparable polyurethane nonwoven fabrics which have been produced by other spinning processes. Despite the special fibre fineness, the individual fibres are unusually long. Elastic nonwoven fabrics of different fibre finenesses (fibre diameters between 0.1 μm and 20 μm) can be produced which, even without further aftertreatment, have excellent strength, elasticity and abrasion resistance.

In contrast to other processes, polyurethane melts can be processed in a melt viscosity range of 20 to 1,000 Pa.s, especially also such polyurethanes of high molecular weight. The primary filament formation in a centrifugal field with a superposed homogeneous rotationally symmetrical flow field permits the use of higher melt viscosities and lower melt temperatures, so that thermal decomposition (degradation) of the polymers is avoided.

The nonwoven fabrics produced stand out, despite their high fibre fineness, due to their high uniformity and are particularly low in conglutinations, twists and undrafted parts. They have uniform strength properties in the longitudinal and transverse directions.

Elastic nonwoven fabrics can be produced without problems by this process with masses per unit area of 4 to 500 g/m2; in particular at low masses per unit area they have excellent surface covering on account of their high fibre fineness. The nonwoven fabrics from special polyurethanes furthermore have excellent chemical and biological resistance (microbial stability).

The elastic superfine fibre nonwoven fabrics can also be combined in various ways with nonwoven fabrics of other polymers. The production process permits, furthermore, the processing of polymer blends of polyurethane and e.g. polyolefins, as a result of which the elastic properties in particular can be purposefully adjusted.

The process according to the invention stands out also due to its excellent profitability.

Examples of the invention are described in the following with the aid of drawings.

Figure 1:
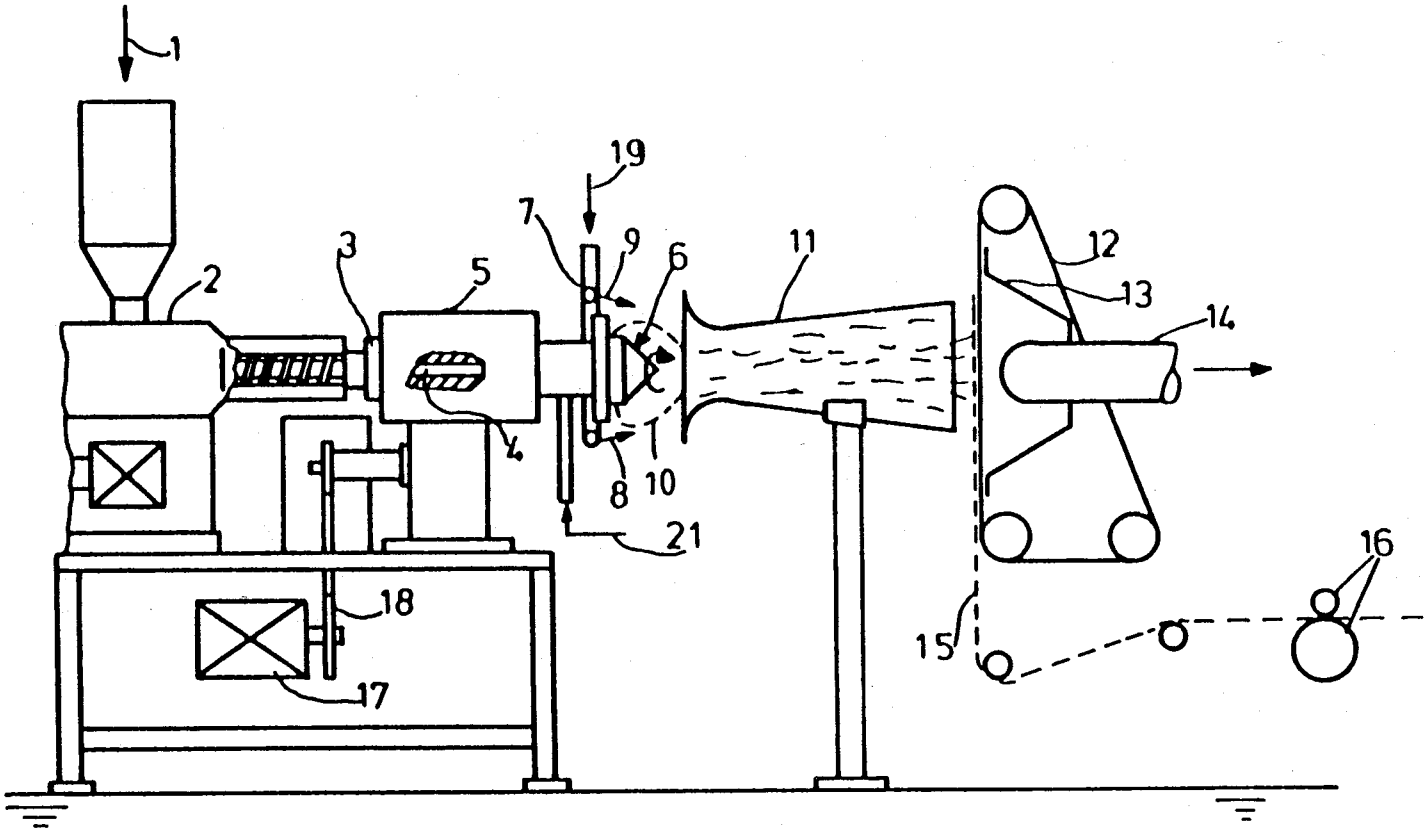
FIG. 1 shows a process scheme for a plant for carrying out the process.

According to FIG. 1 the polymer granules 1 of a thermoplastic polyurethane are melted in an extruder 2 and led at a pressure controlled at a constant value in the region of 5 bar via a rotating seal 3 in a central, rotating melt passage 4 in a housing 5 which simultaneously serves for the bearing arrangement. The melt passage 4 is connected with a rotating nozzle head 6, whose rotation speed is in the range of 1,000 to 11,000 rpm, preferably 6,000 to 9,000 rpm. From the nozzle head 6 the polymer melt emerges radially through small holes on the periphery at an angle of 90° to the axis of rotation. Owing to the melt supply pressure of 5 to 20 bar adjacent to the holes, continuous mass flow rates of 0.01 to 2 g/min per hole are produced. These streams are picked up by a deflecting gas stream 8, which emerges from the annular duct 7 and flows with a predominantly axial component, and are as a result drawn and stretched to continuous long superfine fibres 10. The fibres 10 are then compacted through a shaft 11 onto a depositing belt 12 with a gas suction system 13, 14 to a nonwoven fabric 15, which is optionally further compacted between heatable rollers 16.

The rotating nozzle head 6 is driven by a motor 17 with a V-belt drive 18. The nozzle head 6 is suitably heated by an electrical induction heating system or by radiant heating by means of an electrical heating coil. The gas for the deflecting streams 8 is supplied through the connection 19. The aerodynamic flow field, which is determining for the drawing process, is explained with the aid of FIG. 2. According to FIG. 2 a supplementary gas stream 21 is introduced via the draft duct 22 into the rearward zone of the nozzle head 6. This gas stream emerges through four axial boreholes 23 arranged with rotational symmetry in the front surface of the nozzle head 6, and is fanned out by centrifugal forces into a radial flow field 24. This flow field has an essentially radial component.

The polyurethane melt 25 to be spun is heated to the temperature above the physical melting point required for the desired adjustment of viscosity and led at a pressure of 5 bar into the centrally rotating melt passage 4 and from there via radial boreholes 26 into an annular chamber 28 disposed in the nozzle head 6 upstream of the melt discharge openings 27.

For adjustment of the desired melt temperature at the outlet of the holes 27, the nozzle head 6 is heated with electrical radiant heaters 29, 30.

The inner supplementary gas stream 21 must have a temperature on leaving the nozzle head which is equal to or slightly greater than the temperature of the nozzle head 6. Owing to the geometry and the rotation of the nozzle head 6 there results a symmetrically fanned-out flow field, which provides for a uniform draft (with regard to the angular distribution) of the primary melt streams 9 emerging from the holes 27. In addition, the cooling of the primary melt streams is delayed. Following this, the melt streams are picked up by the outer gas streams 8 emerging from the blast ring 7, deflected axially and drawn out to superfine fibres 10 (see also FIG. 1).

Furthermore blast nozzles 31*a*, 31*b* are disposed at an axial distance a=40 mm from the melt discharge holes 27, and are fed from distributors 33*a*, 33*b* outside the flow field. As a result of this gas streams 34*a*, 34*b* are produced which are directed as delimiting gas streams at an angle $\alpha$ of 30° to the axis onto the axially deflected fibre stream. The gas is supplied to the distributors 33*a*, 33*b* under pressure via the feed lines 32*a*, 32*b*. The radial distance of the distributor from the axis of rotation is twice the nozzle head radius. Owing to the delimiting gas streams 34*a*, 34*b* the fibre-air mixture is homogenized over the cross-section just before it enters the shaft 11 (see FIG. 1). (Production of a nonwoven fabric with a uniform mass per unit area and uniform mechanical properties).

It has further proved advantageous for the delimiting gas streams 34*a*, 34*b* to be pulsated. The pulsation, which is for example sinusoidal, can be in-phase or alternating phased (inversely phased). The pulsation frequency can be in the range of 0.5 $s^{-1}$ to 5 $s^{-1}$.

Figure 3:
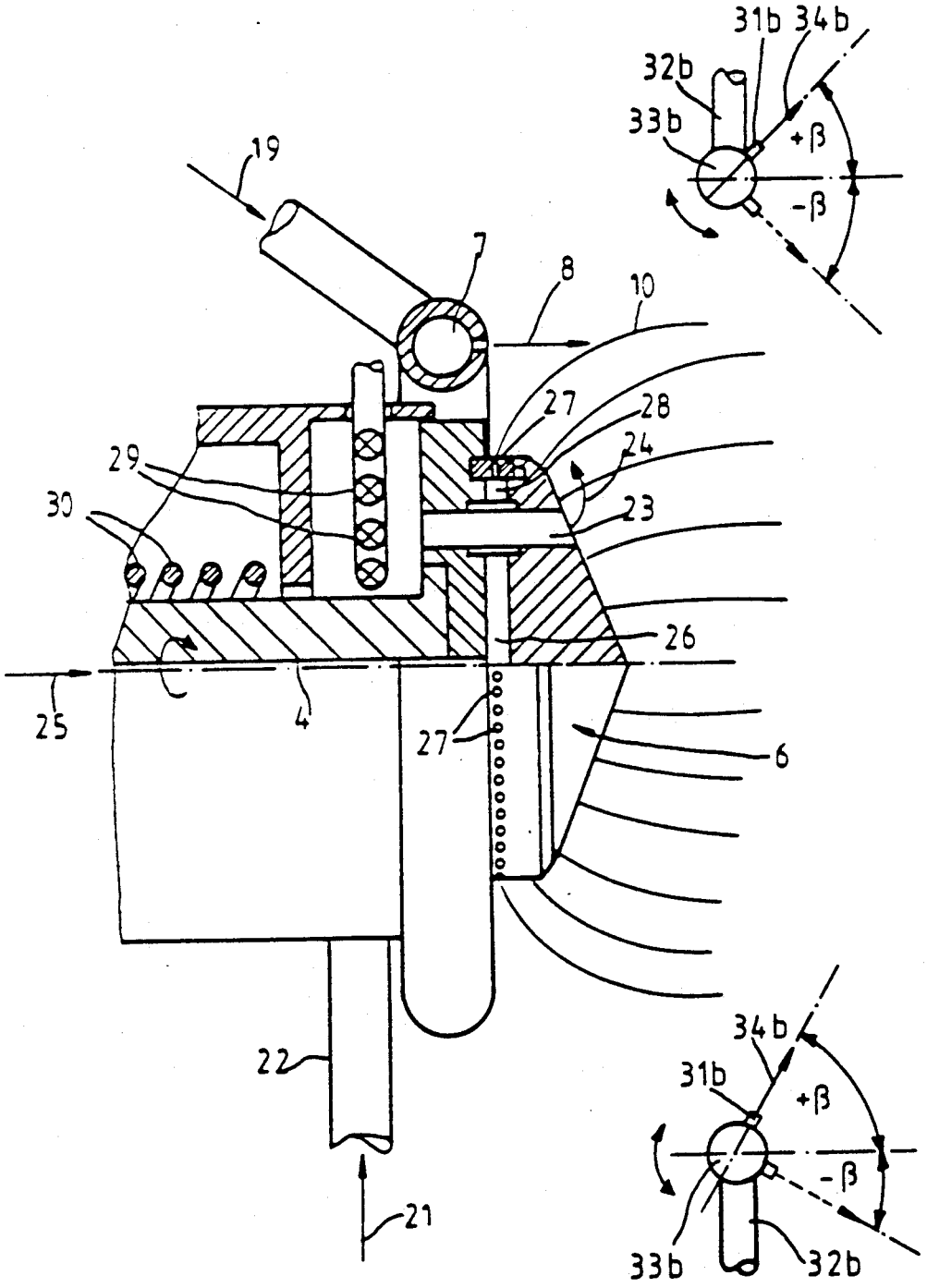

A further advantageous variant consists in aligning the delimiting gas streams 34*a*, 34*b* mutually parallel and swivelling them through an angular range of $\pm 10° \leqq \beta \leqq \pm 70°$ to the axis of the fibre stream with a frequency of 0.5 $s^{-1}$ to 5 $s^{-1}$. By this means, especially with several nozzle heads 6 operated in parallel, a more uniform fibre deposition is achieved (FIG. 3).

EXAMPLE 1

Figure 2:
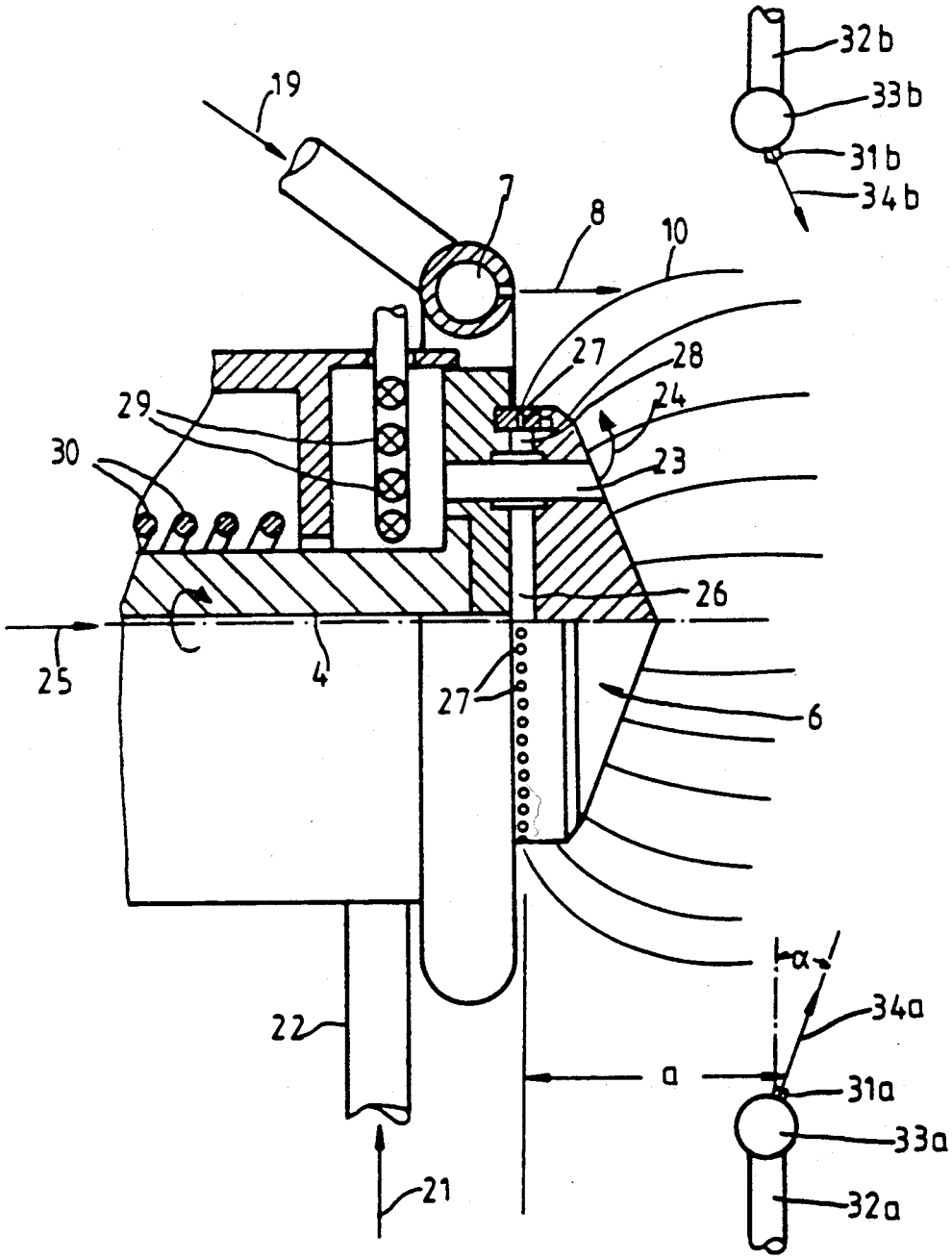
FIG. 2 shows the construction of a nozzle head with devices for the production of delimiting gas streams and FIG. 3 shows a nozzle head with swivelling devices for the production of the delimiting gas streams.

A commercially-available thermoplastic polyester-polyurethane known as Desmopan® was spun in an apparatus according to FIGS. 1 and 2. The material had a density of 1.2 g/cm3, a glass transition temperature of −42° C., a softening temperature of +91° C. and a melting temperature range of 180 ° C. to 250° C. The viscosity of the melt was 60 Pa.s at a temperature of 230° C. and a shear rate of 400 $s^{-1}$. The melt temperature was 225° C. and the temperature of the nozzle head 240° C. The nozzle head rotated at 9,000 rpm. As a result, a throughput of 0.2 g/min per hole 27 was reached. The quantity ratio of the inner gas stream 21 to the outer drawing gas stream 19 was 0.4, the temperature of the outer deflecting gas stream 19 20° C. and that of the inner supplementary gas stream 21 260° C. The two opposite delimiting gas streams 34*a* and 34*b* had an axial distance a of 40 mm (see FIG. 2) and a radial distance 2r from the rotation axis, where r is the nozzle head radius. The setting angle $\alpha$ to the normals (see FIG. 2) was 30°. The ratio of the throughputs of these two gas streams 34*a* and 34*b* to the sum of the gas streams 19 and 21 introduced at the nozzle head was 0.3, and the temperature of the delimiting gas streams 20 ° C. The superfine fibres 10 spun in this way had a mean fibre diameter of 3.5 μm at a standard deviation of 1.9 μm. This result was obtained by counting 250 fibres in a scanning electron microscope. The deposited nonwoven fabric had excellent uniformity over the width and the following strength properties as a function of the mass per unit area:

TABLE I

| Mass per unit area [g/m2] | BF Breaking force [N/cm] | BE Breaking elongation [%] | Recovery after elongation at 25% of BF [%] |
|---|---|---|---|
| 50 longit. | 3.2 | 458 | 26 |
| transv. | 2.6 | 370 | 28 |
| 80 longit. | 6.8 | 482 | 27 |
| transv. | 5.7 | 475 | 28 |
| 130 longit. | 10.5 | 511 | 32 |
| transv. | 7.3 | 480 | 21 |

longit. = longitudinal
transv. = transverse

Example 2

With the same apparatus and at otherwise the same adjustments, the mass throughput was reduced to 0.1 g/min per hole and the delimiting gas streams 34*a*, 34*b* adjusted to give a quantity ratio to the total of the gas streams 19, 21 fed into the nozzle head 6 of 0.2. As a result, a mean fibre diameter of 1.3 μm with a standard deviation of 0.7 μm was obtained (measurement analogous to Example 1). The strength properties, already defined in connection with Example 1, are assembled in the following Table II.

TABLE II

| Mass per unit area [g/m2] | BF [N/cm] | BE [%] | Recovery [%] |
|---|---|---|---|
| 68 longit. | 2.7 | 280 | 15 |
| transv. | 2.5 | 255 | 11 |
| 105 longit. | 3.7 | 255 | 13 |
| transv. | 3.6 | 230 | 10 |

longit. = longitudinal
transv. = transverse

By comparison with Example 1, the nonwoven fabric according to Example 2 had a higher internal uniformity and surface covering.

We claim:

1. Process for the production from thermoplastic polymers of superfine polymer fibre nonwoven fabrics with a mean fibre diameter of 0.1 μm–20 μm, in which the molten polymer at a supply pressure of 1 bar–200 bar in a rotating nozzle head is spun out radially from a plurality of melt discharge holes to form fibres and the not yet completely solidified fibres are deflected in an axial direction at a radial distance of 10 mm to 200 mm from the discharge holes by an outer gas stream and afterwards deposited as nonwoven fabric on a circulating, air-permeable carrier, comprising in addition to the outer gas stream of high velocity, at a smaller radial distance than the melt discharge holes there emerges from a plurality of axial boreholes in the nozzle head an inner gas stream with lower velocity which, under the influence of the centrifugal sweeping forces arising at the rotating nozzle head, forms a rotationally symmetrical flow field with a predominantly radial velocity component and whose temperature is equal to or greater than the nozzle head temperature.

2. Process according to claim 1, wherein the ratio of the inner to the outer gas flow rates is adjusted to a value between 0.2 and 2.0.

3. Process according to claim 1, wherein the inner gas stream discharges from 2 to 20 boreholes running axially in the rotating nozzle head.

4. Process for the production from thermoplastic polymers of superfine polymer fibre nonwoven fabrics with a mean fibre diameter of 0.1 μm–20 μm, in which the molten polymer at a supply pressure of 1 bar–200 bar in a rotating nozzle head is spun out radially from a plurality of melt discharge holes to form fibres and the not yet completely solidified fibres are deflected in an axial direction at a radial distance of 10 mm to 200 mm from the discharge holes by an outer gas stream and afterwards deposited as nonwoven fabric on a circulating, air-permeable carrier, comprising in addition to the outer gas stream of high velocity, at a smaller radial distance than the melt discharge holes there emerges from a plurality of axial boreholes in the nozzle head an inner gas stream with lower velocity which, under the influence of the centrifugal sweeping forces arising at the rotating nozzle head, forms a rotationally symmetrical flow field with a predominantly radial velocity component and whose temperature is equal to or greater than the nozzle head temperature and wherein outside the nozzle head at an axial distance 0 mm $\leqq$ a $\leqq$ 500 mm from the melt discharge holes, at least two further delimiting gas streams are directed at an angle of 0° to 70° to the axis onto the axially deflected fibre stream.

5. Process according to claim 4, wherein the ratio of the sum of the delimiting gas flow rates to the sum of the outer and inner gas flow rates is adjusted to a value between 0 and 1.

6. Process according to claim 4, wherein the delimiting gas streams are blown in at a radial distance which is 1 to 5 times the nozzle head radius.

7. Process according to claim 4, wherein the delimiting gas streams pulsate in phase or inversely phased.

8. Process according to claim 4, wherein the delimiting gas streams are aligned mutually parallel and swivelled through an angular range of ±10° to ±70° to the axis of the fibre stream with a frequency of 0.5 $s^{-1}$ to 5 $s^{-1}$.

9. Process according to claim 1, wherein polyester-, polyether- or poly-ethercarbonate- urethane is used as polymer.

10. Process according to claim 2, wherein the inner gas stream discharges from 2 to 10 boreholes running axially in the rotating nozzle head.

11. Process according to claim 4 wherein outside the nozzle head at an axial distance 0 mm ≦ a ≦ 500 mm from the melt discharge holes, at least two further delimiting gas streams are directed at an angle of 10° to 60° to the axis onto the axially deflected fibre stream.

12. Process according to claim 4 wherein the ratio of the sum of the delimiting gas flow rates to the sum of the outer and inner gas flow rates is adjusted to a value between 0 and 0.5.

13. Process according to claim 4 wherein the delimiting gas streams are blown in at a radial distance which is 1 to 3 times the nozzle head radius.

* * * * *